US008587369B2

(12) United States Patent
Jang et al.

(10) Patent No.: US 8,587,369 B2
(45) Date of Patent: Nov. 19, 2013

(54) DOWN-CONVERTING VOLTAGE GENERATING CIRCUIT

(75) Inventors: Chae Kyu Jang, Icheon-si (KR); Jong Hyun Wang, Icheon-si (KR); Sang Don Lee, Icheon-si (KR)

(73) Assignee: SK Hynix Inc., Gyeonggi-do (KR)

( * ) Notice: Subject to any disclaimer, the term of this patent is extended or adjusted under 35 U.S.C. 154(b) by 146 days.

(21) Appl. No.: 13/339,034

(22) Filed: Dec. 28, 2011

(65) Prior Publication Data

US 2012/0306470 A1 Dec. 6, 2012

(30) Foreign Application Priority Data

Jun. 3, 2011 (KR) ..... 10-2011-0053858

(51) Int. Cl.
*G05F 3/16* (2006.01)
*G05F 3/24* (2006.01)

(52) U.S. Cl.
USPC ..... 327/541; 323/349

(58) Field of Classification Search
USPC ..... 327/538, 540, 541; 323/313, 314, 349, 323/901
See application file for complete search history.

(56) References Cited

U.S. PATENT DOCUMENTS

| | | | | |
|---|---|---|---|---|
| 6,683,445 | B2 * | 1/2004 | Park | 323/315 |
| 6,774,712 | B2 * | 8/2004 | Rhee et al. | 327/540 |
| 7,298,200 | B2 * | 11/2007 | Won | 327/541 |
| 7,417,494 | B2 * | 8/2008 | Choi et al. | 327/541 |
| 7,750,729 | B2 * | 7/2010 | Lee et al. | 327/544 |

FOREIGN PATENT DOCUMENTS

KR 1020070000166 A 1/2007

* cited by examiner

*Primary Examiner* — Gary L Laxton
(74) *Attorney, Agent, or Firm* — William Park & Associates Patent Ltd.

(57) ABSTRACT

A down-converting voltage generating circuit includes a reference voltage providing unit, an initial setting unit, a driving unit, and a driving force control unit. The reference voltage providing unit provides a reference voltage to a first node. The initial setting unit drops a voltage level of the first node to substantially a level of a ground voltage when an initial setting signal is activated. The driving unit drives a down-converted voltage derived from an external voltage in response to the voltage level of the first node. The driving force control unit is connected to the driving unit, and controls a driving force for driving the down-converted voltage of the driving unit in response to the initial setting signal.

34 Claims, 3 Drawing Sheets

DOWN-CONVERTING VOLTAGE GENERATING CIRCUIT

CROSS-REFERENCES TO RELATED APPLICATION

The present application claims priority under 35 U.S.C. §119(a) to Korean application number 10-2011-0053858 filed on Jun. 3, 2011 in the Korean Intellectual Property Office, which is incorporated herein by reference in its entirety as set forth in full.

BACKGROUND

1. Technical Field

The present invention relates to a semiconductor device, and more particularly, to a down-converting voltage generating circuit.

2. Related Art

A semiconductor device has a circuit for generating various is internal voltages (VPP, VBB, VCORE, etc.) from an external voltage so as to perform a stable operation. In this case, the internal voltages are generated using a charge-pumping method or down-converting method. The charge-pumping method is used to generate a pumping voltage (VPP), bulk voltage (VBB) or the like, and the down-converting method is used to generate a core voltage (VCORE) that is an internal voltage having a level lower than that of the external voltage, or the like.

FIG. 1 is a circuit diagram of a related art for a down-converting voltage generating circuit.

A voltage generated using the down-converting method is defined as a down-converted voltage VDC, and a circuit for generating the down-converted voltage VDC is defined as a down-converting voltage generating circuit. The related art for a down-converting voltage generating circuit uses a method in which an external voltage is applied as a down-converted voltage VDC in the initial stage of a power-up operation for the purpose of fast ramping of the down converted voltage VDC.

The down-converting voltage generating circuit includes a reference voltage providing unit 10, an initial setting unit 20, and a voltage driving unit 30.

The reference voltage providing unit 10 stably supplies a reference voltage VREF to a first node NODE1 by feeding back an output thereof.

If an activated initial setting signal EXT_ON is applied to the initial setting unit 20, the initial setting unit 20 drops a voltage level of the first node NODE1 to the level of a ground voltage (VSS). The activated signal may be asserted to a logic high level in positive logic or asserted to a logic low level in negative logic. Similarly, a deactivated signal may be deasserted to a logic low level in positive logic or deasserted to a logic high level in negative logic. The initial setting signal EXT_ON is activated in the initial stage of the power-up operation, and is deactivated after a predetermined time elapses.

The voltage driving unit 30 drives and outputs a down-converted voltage VDC from an external voltage VCCE in response to the voltage level of the first node NODE1.

In the related art down-converting voltage generating circuit, if the activated initial setting signal EXT_ON is applied to the initial setting unit 20 in the initial stage of the power-up operation, a first switch N1 is turned on so as to apply the level of the ground voltage VSS to the first node NODE1. Therefore, first to fourth drivers P1 to P4 are turned on so that the external voltage VCCE is outputted as the down-converted voltage VDC.

Subsequently, if the initial setting signal EXT_ON is deactivated, the reference voltage VREF is applied to the voltage driving unit 30, and therefore, the level the down-converted voltage VDC is converged to the level of a target voltage VTG after a predetermined time elapses.

FIG. 2 is a graph illustrating an operation of the related art for the down-converting voltage generating circuit.

The external voltage VCCE rises up to point A and then stabilizes. Since the activated initial setting signal EXT_ON is applied in the initial stage of the power-up operation, the down-converted voltage VDC rises with the external voltage VCCE up to point A, and maintains the voltage of the external voltage VCCE up to point B. In this case, during the period from point A to point B, the down-converted voltage VDC is driven to be as high as the external voltage VCCE, where the voltage VCCE is higher than that of the set target voltage VTG. This may stress any circuitry or device which is expecting a voltage not much greater than VTG.

Subsequently, if the initial setting signal EXT_ON is deactivated at point B, there occurs a period from point B to point C in which the voltage level of the first node NODE1 rises from the level of the ground voltage to the level of the reference voltage VREF. Therefore, the down-converted voltage VDC decreases from the voltage VCCE to the target voltage VTG. However, during the period from before point A, when the down-converted voltage VDC first goes past the target voltage VTG to point C when the down-converted voltage drops down to the target voltage VTG, a circuit receiving the down-converted voltage VTG may malfunction due to an incorrect level of the down-converted voltage VDC.

SUMMARY

A down-converting voltage generating circuit designed so that a down-converted voltage can rapidly and stably reach the level is of a target voltage in the initial stage of a power-up operation is described.

In one embodiment of the present invention, a down-converting voltage generating circuit includes a reference voltage providing unit configured to provide a reference voltage to a first node, an initial setting unit configured to drop a voltage level of the first node to substantially a level of a ground voltage when an initial setting signal is activated, a driving unit configured to drive a down-converted voltage derived from an external voltage in response to the voltage level of the first node, and a driving force control unit configured to be connected to the driving unit to control a driving force for driving the down-converted voltage of the driving unit in response to the initial setting signal.

In another embodiment of the present invention, a down-converting voltage generating circuit includes a reference voltage providing unit configured to provide a reference voltage to a first node, an initial setting unit configured to drop a voltage level of the first node to substantially a level of a ground voltage when an initial setting signal is activated, a driving unit configured to drive a down-converted voltage derived from an external voltage in response to the voltage level of the first node, and a voltage discharge unit configured to lower the down-converted voltage to substantially a level of a target voltage in response to the initial setting signal.

In still another embodiment of the present invention, a down-converting voltage generating circuit includes a reference is voltage providing unit configured to provide a reference voltage to a first node, an initial setting unit configured to lower a voltage level of the first node to substantially a level of a ground voltage when an initial setting signal is activated, a driving unit configured to drive a down-converted voltage derived from an external voltage in response to the voltage level of the first node, a driving force control unit configured to be connected to the driving unit to control a driving force for driving the down-converted voltage of the driving unit in response to the initial setting signal, and a voltage discharge unit configured to lower the down-converted voltage to substantially a level of a target voltage in response to the initial setting signal.

In still another embodiment of the present invention, a down-converting voltage generating circuit includes a segment driving unit configured to output a first output voltage derived from an external voltage in an initial stage of a power-up operation and then lower the first output voltage to substantially a level of a target voltage after a first predetermined time elapses, a target driving unit configured to drive a second output voltage derived from the external voltage in response to a level of a reference voltage, a selection unit configured to output one of the first and second output voltages as a down-converted voltage in response to a selection signal, and a selection signal generation unit configured to generate the activated selection signal when the target driving unit drives the second output voltage whose voltage level is lower than that of the target voltage after the power-up operation.

The down-converting voltage generating circuit according to the present invention enables a down-converted voltage to rapidly reach the level of a target voltage in an initial stage of a power-up operation so that the down converted voltage can be rapidly and stably generated.

BRIEF DESCRIPTION OF THE DRAWINGS

Features, aspects, and embodiments are described in conjunction with the attached drawings, in which.

DETAILED DESCRIPTION

A down-converting voltage generating circuit according to the present invention will be described below with reference to the is accompanying drawings through exemplary embodiments.

Figure 3:
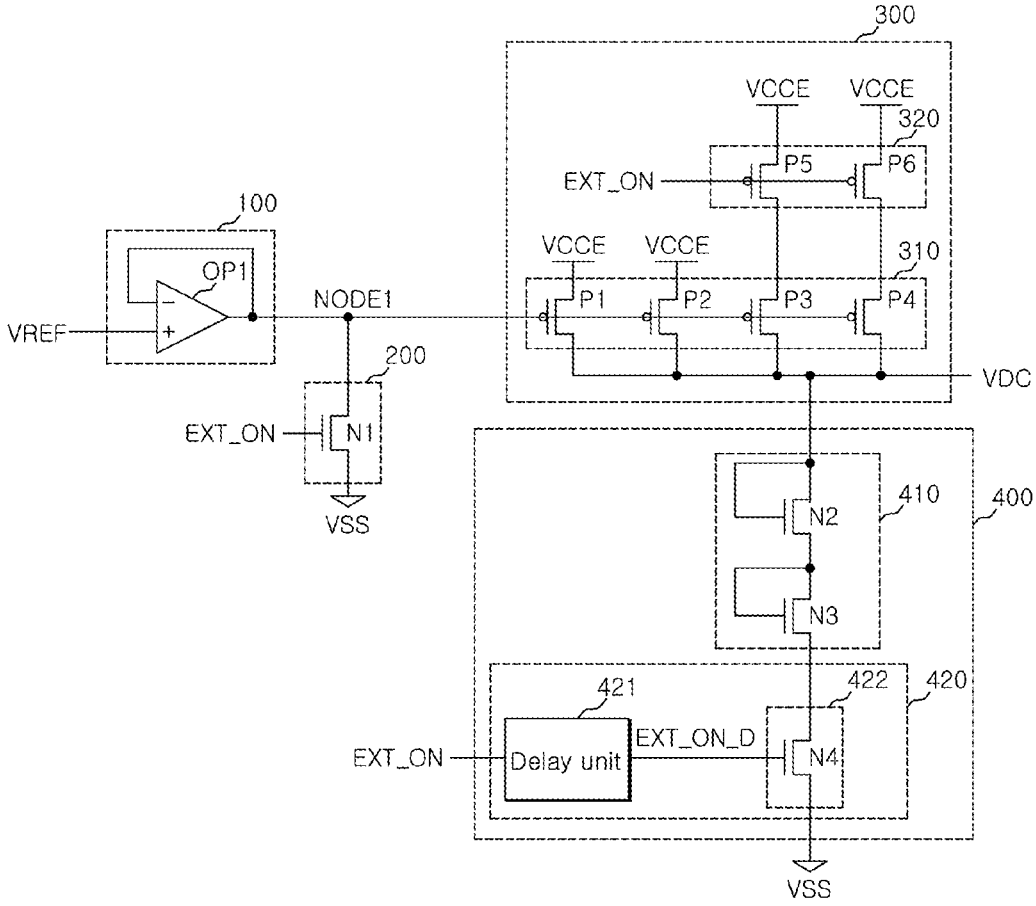
FIG. 3 is a circuit diagram of an exemplary down-converting voltage generating circuit according to one embodiment of the invention.

FIG. 3 is a circuit diagram of an exemplary down-converting voltage generating circuit according to one embodiment of the invention.

The down-converting voltage generating circuit according to this embodiment includes a reference voltage providing unit 100, an initial setting unit 200, and a voltage driving unit 300.

The reference voltage providing unit 100 provides a stable reference voltage VREF to a first node NODE1 by feeding back an output.

The initial setting unit 200 drops a voltage level of the first node NODE1 to the level of a ground voltage VSS when an initial setting signal EXT_ON is activated. The initial setting signal EXT_ON is a signal indicating initial setting in a power-up operation. The initial setting signal EXT_ON is activated in the power-up operation, and is deactivated after a predetermined time elapses.

The voltage driving unit 300 derives a down-converted voltage VDC from an external voltage VCCE in response to the voltage level of the first node NODE1, and can control a driving force for driving the down-converted voltage VDC based on the initial setting signal EXT_ON. For example, a strong driving force may drive the down-converted voltage VDC to a higher level in a same amount of time, or a shorter amount of time, than a weaker driving force.

In this embodiment, the down-converted voltage VDC is generated to have a level identical to that of the external voltage VCCE for the purpose of fast ramping in an initial stage of the power-up operation. In this case, there occurs a period in which the external voltage VCCE is higher than a set target voltage VTG. Thus, the supply of a source is reduced by decreasing the driving force for driving the down-converted voltage VDC from the external voltage VCCE in the period, so that the target voltage VTG can be rapidly and stably generated.

When the down-converted voltage VDC reaches a certain level, the down-converted voltage VDC having the level of the target voltage VTG is generated from the external voltage VCCE through the reference voltage VREF.

The reference voltage providing unit 100 includes a first comparator OP1. The reference voltage VREF is applied to one terminal of the first comparator OP1, and an output of the comparator OP1 is fed back to the other terminal of the first comparator OP1, so that the stable reference voltage VREF is provided to the first node NODE1.

The initial setting unit 200 includes a first switch N1. The initial setting signal EXT_ON is applied to a gate terminal of the first switch N1, and the first switch N1 is connected to the first node NODE1 and the ground voltage VSS. Thus, if the activated initial setting signal EXT_ON is applied to the first switch N1, the first node NODE1 has a voltage level of the ground voltage VSS.

The voltage driving unit 300 includes a driving unit 310 and a driving force control unit 320. The driving unit 310 drives the is down-converted voltage VDC from the external voltage VCCE in response to the voltage level of the first node NODE1. The driving force control unit 320 controls the driving force of the driving unit 310 in response to the initial setting signal EXT_ON.

The driving unit 310 includes first to fourth drivers P1 to P4. The number of drivers can be changed depending on specifications of the drivers. The first to fourth drivers P1 to P4 are connected in parallel to receive the voltage level of the first node NODE1 through a gate terminal of each of the drivers P1 to P4, and output the down-converted voltage VDC through a drain terminal of each of the drivers P1 to P4. A source terminal of each of the drivers P1 to P4 is connected to the external voltage VCCE or the driving control unit 320, according to the rate at which the driving force is to be decreased. In this embodiment, the external voltage VCCE is applied to the source terminals of the first and second drivers P1 and P2, and the source terminals of the third and fourth drivers P3 and P4 are connected to the driving force control unit 320 so as to control the driving force.

The number of drivers for the driving force control unit 320 may be as many as the number of drivers of the driving unit 310, with which the driving force to be decreased. In this embodiment, the driving force control unit 320 includes fifth and sixth drivers P5 and P6. The initial setting signal EXT_ON is applied to gate terminals of the fifth and sixth drivers P5 and P6, and the external voltage VCCE is applied to source terminals of the fifth and sixth drivers P5 and P6. Drain terminals of the fifth and sixth drivers P5 and P6 are connected to the source terminals of the third and fourth drivers P3 and P4, respectively.

A specific operation of the down-converting voltage generating circuit will be described below.

If the initial setting signal EXT_ON is activated in the power-up operation, the first switch N1 of the initial setting unit 200 is turned on, and therefore, the voltage level of the first node NODE1 is dropped to the level of the ground voltage VSS.

Since the fifth and sixth drivers P5 and P6 of the driving force control unit 320 are turned off by the activated initial setting signal EXT_ON, only the first and second drivers P1 and P2 among the drivers of the driving unit 310 are turned on. That is, the ground voltage VSS only turns on the drivers P1 and P2 of the driving unit 310, so that the number of operating drivers decreases in the period in which the level of the external voltage VCCE is outputted as the level of the down-converted voltage VDC.

Subsequently, if the initial setting signal EXT_ON is deactivated, the first switch N1 of the initial setting unit 200 is turned off, and therefore, the voltage level of the first node NODE1 rises to the level of the reference voltage VREF.

Since the fifth and sixth drivers P5 and P6 of the driving force control unit 320 are turned on by the deactivated initial setting signal EXT_ON, all the drivers P1 to P4 of the driving unit 310 are turned on. Therefore, the down-converted voltage VDC is driven is from the external voltage VCCE in response to the voltage level of the first node NODE1, which rises to the level of the reference voltage VREF. The reference voltage VREF is adjusted so that the drivers P1 to P4 can drive the down-converted voltage VDC to converge up to the level of the target voltage VTG. Thus, if the reference voltage VREF is stably applied to the first node NODE1, the down-converted voltage VDC having the level of the target voltage VTG can be driven from the external voltage VCCE.

The down-converting voltage generating circuit can further include a voltage discharge unit 400.

The voltage discharge unit 400 includes a discharge unit 410 and a timing control unit 420.

The discharge unit 410 discharges the down-converted voltage VDC when discharge timing is reached by the timing control unit 420.

The timing control unit 420 includes a delay unit 421 and a control unit 422. The delay unit 421 delays the initial setting signal EXT_ON by a predetermined period and outputs the delayed initial setting signal EXT_ON_D. The predetermined period can be set to a period from the time when the power-up operation is started to the time when the down-converted voltage VDC is driven to be higher by a predetermined level than the target voltage VTG. The control unit 422 controls whether the discharge operation is performed in response to the delayed initial setting signal EXT_ON_D.

When the down-converted voltage VDC is higher by the predetermined level than the target voltage VTG in the period when the down-converted voltage VDC is generated to have a level identical to that of the external voltage VCCE in the initial stage of the power-up operation, the voltage discharge unit 400 discharges the down-converted voltage VDC so that the target voltage can be rapidly and stably generated.

In the discharge unit 410, for example, NMOS transistors N2 and N3 are diode-connected to the terminal through which the down-converted voltage VDC is outputted and the control unit 422. In this case, as the down-converted voltage VDC is higher, the discharge operation is performed faster. Alternatively, resistors having a fixed resistance can be used as the discharge unit 410.

The control unit 422 includes a second switch N4. The delayed initial setting signal EXT_ON_D outputted from the delay unit 421 is applied to a gate terminal of the second switch N4, and a source terminal of the second switch N4 is connected to the ground voltage VSS. A gate terminal of the second switch N4 is connected to the discharge unit 410.

A specific operation of the voltage discharge unit 400 is described below.

The delay unit 421 delays the activated initial setting signal EXT_ON and outputs the delayed initial setting signal EXT_ON_D in the power-up operation. Thus, the delayed initial setting signal EXT_ON_D is activated after the time when the down converting voltage VDC is driven to be higher by the predetermined level than the target voltage VTG.

If the delayed initial setting signal EXT_ON_D is activated, the second switch N4 of the control unit 422 is turned on, and therefore, the discharge of the down-converted voltage VDC is started. In the discharge unit 410, a device value is set so that the down-converted voltage VDC is discharged to the level of the target voltage VTG. Thus, the voltage discharge unit 400 is added to the down-converting voltage generating circuit so that the down-converting voltage generating circuit can rapidly and stably generate the down-converted voltage VDC to have the level of the target voltage VTG.

Figure 4:
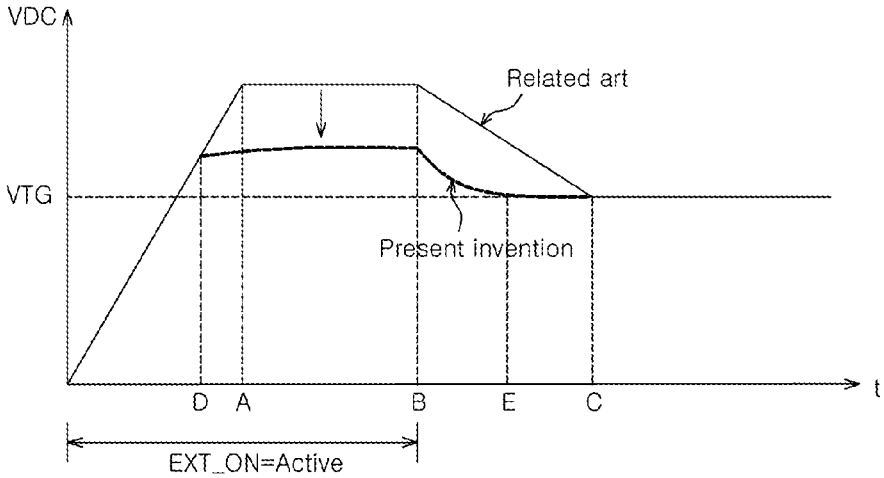
FIG. 4 is a graph illustrating an operation of the down-converting voltage generating circuit of FIG. 3.

FIG. 4 is a graph illustrating an operation of the down-converting voltage generating circuit including the reference voltage providing unit 100, the initial setting unit 200, the voltage driving unit 300, and the voltage discharge unit 400.

The initial setting signal EXT_ON is activated from the start of the graph to point B and then deactivated. Therefore, the down-converted voltage VDC has a voltage level of the external voltage until point B. In the related art for the down-converting voltage generating circuit, the down-converted voltage VDC rises until point A as the external voltage VCCE rises. However, in the down-converting voltage generating circuit according to an embodiment of the present invention, the driving force of the external voltage VCCE of the voltage driving unit 300 is decreased, and the discharge of the down-converted voltage VDC is performed from point D when the delayed initial setting signal EXT_ON_D is activated. Thus, it is possible to prevent the down-converted voltage VDC from rising to the maximum level of the external voltage VCCE.

The period from point B to point C is a period when the voltage level of the first node NODE1 rises to the reference voltage VREF. In the period from point B to point C, the level of the down-converted voltage VDC is dropped to that of the target voltage VTG. In this embodiment, if the initial setting signal EXT_ON is deactivated, the discharge operation is not immediately stopped, but is continued until a predetermined period (point E) and then stopped so that the down-converted voltage VDC rapidly reaches the level of the target voltage VTG.

After point E, the voltage driving unit 300 drives the down-converted voltage VDC with the level of the target voltage VTG from the external voltage VCCE in response to the reference voltage VREF. In the related art, the down-converted voltage VDC having the level of the target voltage VTG is generated after point C. However, in the present invention, the down-converted voltage VDC having the level of the target voltage VTG can be generated at a time (point E) before point C.

Figure 5:
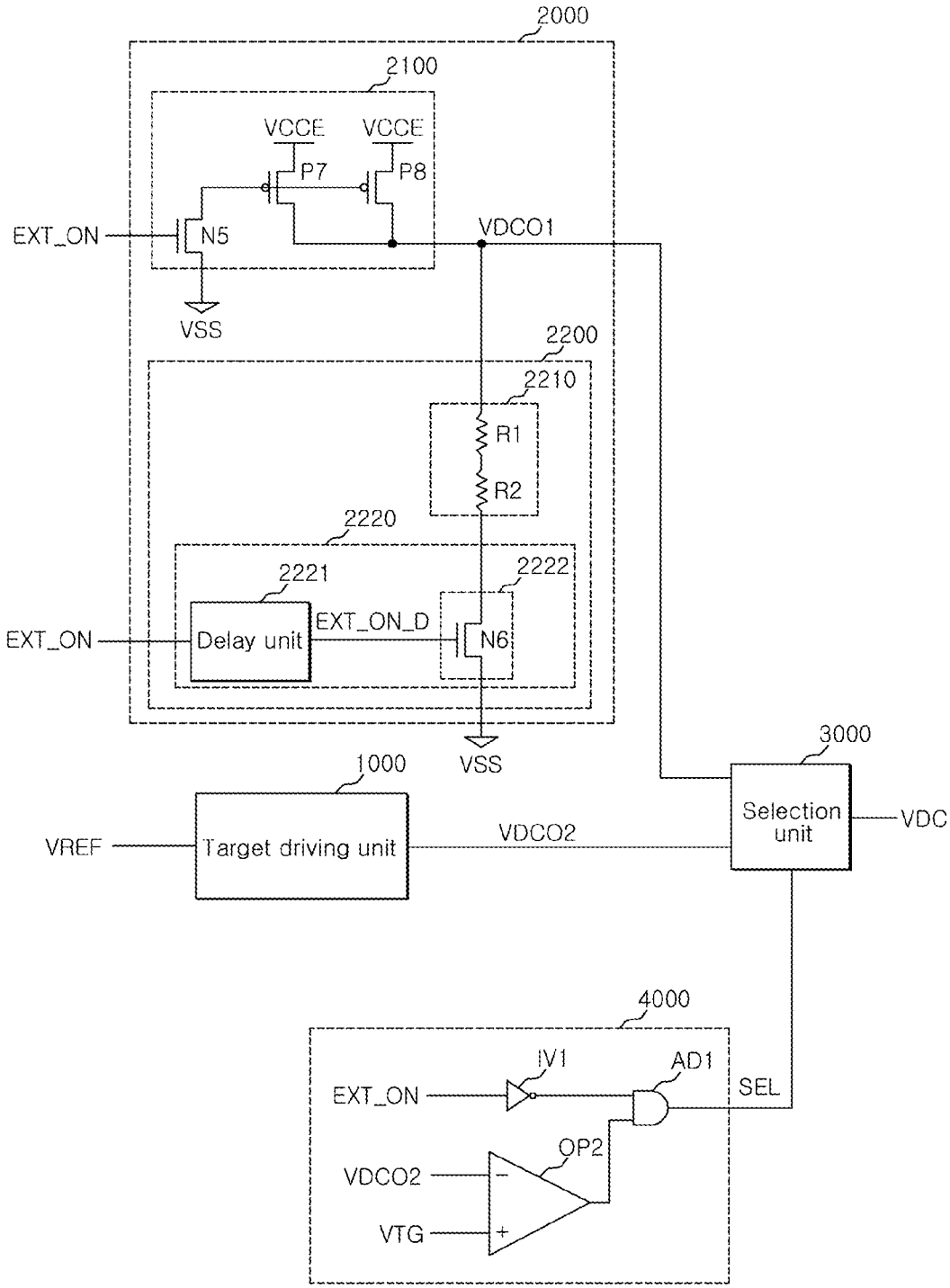
FIG. 5 is a circuit diagram of an exemplary down-converting voltage generating circuit according to another embodiment of the to invention.

FIG. 5 is a circuit diagram of an exemplary down-converting voltage generating circuit according to another embodiment of the invention.

The down-converting voltage generating circuit according to this embodiment includes a segment driving unit 2000, a target driving unit 1000, a selection unit 3000, and a selection signal generation unit 4000.

The segment driving unit 2000 outputs the level of an external voltage VCCE as a first output voltage VDCO1 in an initial stage of a power-up operation and then discharges the first output voltage VDCO1 to the level of a target voltage after a first predetermined time elapses.

The target driving unit 1000 is the related art for a down-converting voltage generating circuit, and drives a second output voltage VDCO2 derived from the external voltage VCCE in response to a reference voltage VREF.

The selection unit 3000 controls whether the first output voltage VDCO1 or the second output voltage VDCO2 is output as a down-converted voltage VDC in response to a selection signal SEL.

The selection signal generation unit 4000 activates the selection signal SEL when the target driving unit 1000 outputs the second output voltage VDCO2 as the level of the target voltage VTG. In one embodiment, the selection signal SEL is generated by combining an initial setting signal EXT_ON, the second output voltage VDCO2, and the target voltage VTG.

In this embodiment, the segment driving unit 2000 for generating the down-converted voltage VDC following the external voltage VCCE and the target driving unit 1000 for generating the down-converted voltage VDC having the level of the target voltage VTG in response to the reference voltage VREF are separately designed. Accordingly, the selection unit 3000 can select and output a down-converted voltage VDC appropriately for different time periods.

The segment driving unit 2000 includes a first output voltage driving unit 2100. The segment driving unit 2000 can further include a voltage discharge unit 2200.

The first output voltage driving unit 2100 includes a third switch N5 and seventh and eighth drivers P7 and P8. The number of drivers can be changed depending on specifications of the drivers. However, the number of drivers is set smaller than that of drivers for driving the second output voltage VDCO2 in the target driving unit 1000. The third switch N5 receives the initial setting signal EXT_ON through a gate terminal, and a source terminal of the third switch N5 is connected to a ground voltage VSS. The initial setting signal EXT_ON is a signal which is activated in the power-up operation and then deactivated after a second predetermined time elapses. The seventh and eighth drivers P7 and P8 are connected in parallel so as to receive a voltage level of a drain terminal of the third switch N5 through gate terminals of the seventh and eighth drivers P7 and P8. An external voltage VCCE is connected to source terminals of the seventh and eighth drivers P7 and P8, and the first output voltage VDCO1 is outputted to drain terminals of the seventh and eighth drivers P7 and P8.

The voltage discharge unit 2200 includes a discharge unit 2210 and a timing control unit 2220. If discharge timing is reached by the timing control unit 2220, the discharge unit 2210 discharges the first output voltage VDCO1. The timing control unit 2220 includes a delay unit 2221 and a control unit 2222. The delay unit 2221 delays the initial setting signal EXT_ON by a first predetermined period and outputs the delayed initial setting signal EXT_ON_D. The first predetermined period can be set to a period from the time when the power-up operation is started to the time when the down-converted voltage VDC is driven to be higher by a predetermined level than the target voltage VTG. The control unit 2222 controls whether the discharge operation is performed in response to the delayed initial setting signal EXT_ON_D.

The discharge unit 2210 can include, for example, resistors R1 and R2 having a fixed resistance. The resistors R1 and R2 are connected in series between a terminal at which the first output voltage VDCO1 is outputted and the control unit 2222.

The control unit 2222 includes a fourth switch N6. The delayed initial setting signal EXT_ON_D outputted from the delay unit 2221 is applied to a gate terminal of the fourth switch N6, and a source terminal of the fourth switch N6 is connected to the ground voltage VSS. A gate terminal of the fourth switch N6 is connected to the discharge unit 2210.

In the segment driving unit 2000, if the initial setting signal EXT_ON activated in the power-up operation is applied to the first output voltage driving unit 2100, the seventh and eighth drivers P7 and P8 of the first output voltage driving unit 2100 are turned on, and, therefore, the external voltage VCCE is outputted as the first output voltage VDCO1. However, the driving force of the first output voltage driving unit 2100 is set lower than that of the second output voltage VDCO2 of the target driving unit 1000. If the delayed initial setting signal EXT_ON_D is activated after a first predetermined time elapses, the fourth switch N6 of the control unit 2222 is turned on, and, therefore, the discharge of the first output voltage VDCO1 is started. The discharge unit 2210 is set so that the first output voltage VDCO1 is discharged substantially to the level of the target voltage VTG.

Although the initial setting signal EXT_ON is deactivated after a second predetermined time elapses so that the seventh and eighth drivers are turned off, the first output voltage VDCO1 is further discharged by a first delay time generated by the delay unit 2221. Thus, the first output voltage VDCO1 can more rapidly and stably approach the level of the target voltage VTG.

Figure 1:
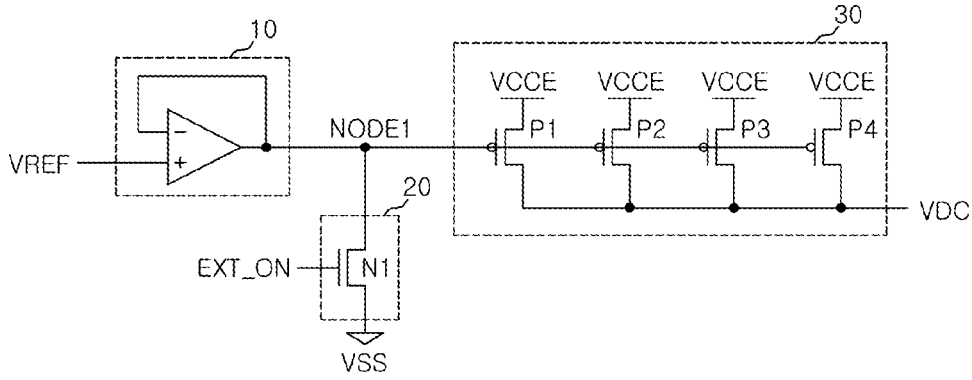
FIG. 1 is a circuit diagram of a related art for a down-converting voltage generating circuit.
Figure 2:
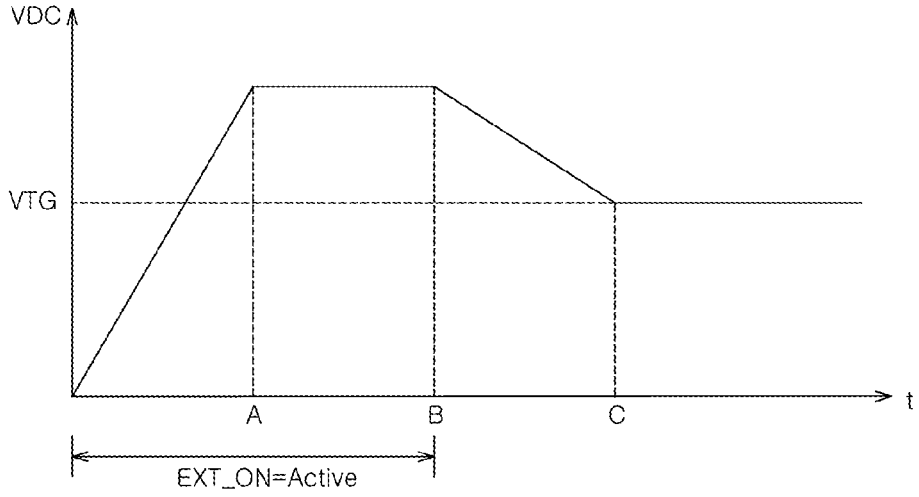
FIG. 2 is a graph illustrating an operation of the related art for a down-converting voltage generating circuit of FIG. 1.

Similarly as explained with respect to FIGS. 1 and 2, the target driving unit 1000 drives the second output voltage VDCO2 having the level of the target voltage VTG from the external voltage VCCE in response to the level of the reference voltage VREF. Similarly to the related art in FIGS. 1 and 2, in the target driving unit 1000, the second output voltage VDCO2 rises to the level of the external voltage VCCE by the activated initial setting signal EXT_ON in the initial stage of the power-up operation. Then, if the initial setting signal EXT_ON is deactivated, the second output voltage VDCO2 having the level of the target voltage VTG is outputted in response to the reference voltage VREF after a predetermined time elapses. Detailed description will be omitted. The related art for a down-converting voltage generating circuit such as, for example, that shown in FIG. 1 may be used as the target driving unit 1000. However, the present invention is not limited thereto.

The selection unit 3000 outputs the first or second output voltage VDCO1 or VDCO2 as the down-converted voltage VDC in response to the selection signal SEL. The selection unit 3000 can be implemented, for example, as a multiplexer. The selection unit 3000 outputs the first output voltage VDCO1 as the down-converted voltage VDC in the period when the selection signal SEL is deactivated, and outputs the second output voltage VDCO2 as the down-converted voltage VDC in the period when the selection signal SEL is activated.

The selection signal generation unit 4000 generates the selection signal SEL by combining the initial setting signal EXT_ON, the second output voltage VDCO2 and the target voltage VTG.

The selection signal generation unit 4000 includes a first inverter IV1, a second comparator OP2, and an AND combiner AD1. The first inverter IV1 inverts the initial setting signal EXT_ON. The second comparator OP2 compares the second output voltage VDCO2 and the target voltage VTG. When the level of the second output voltage VDCO2 is higher than that of the target voltage, the second comparator OP2 outputs a low level. When the level of the second output voltage VDCO2 is lower than that of the target voltage, the second comparator OP2 outputs a high level. The AND combiner AD1 generates a high level only when all outputs of the first inverter IV1 and the second comparator OP2 have a high level. That is, the AND combiner AD1 generates the activated selection signal SEL only when all the outputs of the first inverter IV1 and the second comparator OP2 have the high level.

A specific operation of the selection signal generation unit 4000 will be described as follows.

When the initial setting signal EXT_ON is activated in the power-up operation, the output of the first inverter IV1 has a low level, and therefore, the selection signal SEL is deactivated at the low level. Subsequently, if the initial setting signal EXT_ON is deactivated, the selection signal SEL is deactivated at a low-level when the output of the second comparator OP2 has the low level. When the output of the second comparator OP2 has a high level, the selection signal SEL is activated as the high level.

That is, the selection signal SEL is deactivated after a predetermined time elapses from the power-up operation of the initial setting signal EXT_ON. When the target driving unit 1000 drives the second output voltage VDCO2 to have a level lower than that of the target voltage TVG, i.e., when the target driving unit 1000 stably outputs the second output voltage VDCO2, the selection signal is activated.

Thus, when the selection signal SEL is applied in the initial is stage of the power-up operation, the down-converting voltage generating circuit according to this embodiment selects the first output voltage VDCO1 and outputs the first output voltage VDCO1 as the down-converted voltage VDC. Then, if the selection signal SEL is activated, the down-converting voltage generating circuit outputs the second output voltage VDCO2 having the stable level of the target voltage VTG as the down-converted voltage VDC.

That is, the first output voltage driving unit 2100 for minimizing an error of the down-converted voltage VDC, which may occur in the initial stage of the power-up operation, is added to the target driving unit 1000 that is the related art down-converting voltage generating circuit, so that the down-converted voltage VDC can bee more rapidly and stably generated in the power-up operation.

While certain embodiments have been described above, it will be understood to those skilled in the art that the embodiments described are by way of example only. Accordingly, the circuit described herein should not be limited based on the described embodiments. Rather, the circuit described herein should only be limited in light of the claims that follow when taken in conjunction with the above description and accompanying drawings.

What is claimed is:

1. A down-converting voltage generating circuit, comprising:

a reference voltage providing unit configured to provide a reference voltage to a first node;

an initial setting unit configured to drop a voltage level of the first node to substantially a level of a ground voltage when an initial setting signal is activated;

a driving unit configured to drive a down-converted voltage derived from an external voltage in response to the voltage level of the first node; and a driving force control unit configured to be connected to the driving unit to control a driving force for driving the down-converted voltage of the driving unit in response to the initial setting signal.

2. The circuit according to claim 1, wherein the initial setting signal is activated in a power-up operation and then deactivated after a predetermined time elapses.

3. The circuit according to claim 2, wherein the driving unit drives the down-converted voltage substantially to a level of the external voltage as the voltage level of the first node is lowered.

4. The circuit according to claim 2, wherein, when the activated initial setting signal is inputted, the driving force control unit decreases the driving force of the driving unit.

5. The circuit according to claim 2, wherein the driving unit comprises a plurality of PMOS transistors that receive a voltage of the first node through corresponding gate terminals and drive the down-converted voltage derived from the external voltage.

6. The circuit according to claim 5, wherein the driving force control unit comprises a plurality of PMOS transistors that receive the initial setting signal through corresponding gate terminals, have source terminals connected to the external voltage, and have drain terminals respectively connected to a source terminal of at least one of the plurality of PMOS transistors of the driving unit.

7. A down-converting voltage generating circuit, comprising:

a reference voltage providing unit configured to provide a reference voltage to a first node;

an initial setting unit configured to drop a voltage level of the first node to substantially a level of a ground voltage when an initial setting signal is activated;

a driving unit configured to drive a down-converted voltage derived from an external voltage in response to the voltage level of the first node; and a voltage discharge unit configured to lower the down-converted voltage to substantially a level of a target voltage in response to the initial setting signal.

8. The circuit according to claim 7, wherein the initial setting signal is activated in a power-up operation and then deactivated after a predetermined time elapses.

9. The circuit according to claim 8, wherein the driving unit drives the down-converted voltage substantially to a level of the external voltage as the voltage level of the first node is lowered.

10. The circuit according to claim 8, wherein the driving unit comprises a plurality of PMOS transistors that receive a voltage of the first node through corresponding gate terminals and drive the down-converted voltage derived from the external voltage.

11. The circuit according to claim 8, wherein the voltage discharge unit comprises:

a timing control unit configured to receive the initial setting signal so as to control a timing when the down-converted voltage is lowered; and a discharge unit configured to lower the down-converted voltage.

12. The circuit according to claim 11, wherein the timing control unit comprises:

a delay unit configured to delay the initial setting signal by a predetermined time and to generate a delayed initial setting signal; and a control unit configured to control the down-converted voltage to be lowered when the delayed initial setting signal is activated.

13. The circuit according to claim 12, wherein the delay unit delays the initial setting signal from the time when the power-up operation is started to the time when the down-converted voltage is driven to be higher by a predetermined level than the target voltage.

14. A down-converting voltage generating unit, comprising:

a reference voltage providing unit configured to provide a reference voltage to a first node;

an initial setting unit configured to lower a voltage level of the first node to substantially a level of a ground voltage when an initial setting signal is activated;

a driving unit configured to drive a down-converted voltage derived from an external voltage in response to the voltage level of the first node;

a driving force control unit configured to be connected to the driving unit to control a driving force for driving the down-converted voltage of the driving unit in response to the initial setting signal; and a voltage discharge unit configured to lower the down-converted voltage to substantially a level of a target voltage in response to the initial setting signal.

15. The circuit according to claim 14, wherein the initial setting signal is activated in a power-up operation and then deactivated after a predetermined time elapses.

16. The circuit according to claim 15, wherein the driving unit drives the down-converted voltage to substantially a level of the external voltage as the voltage level of the first node is lowered.

17. The circuit according to claim 15, wherein, when the activated initial setting signal is inputted, the driving force control unit decreases the driving force of the driving unit.

18. The circuit according to claim 15, wherein the driving unit comprises a plurality of PMOS transistors that receive a voltage of the first node through corresponding gate terminals and drive the down-converted voltage derived from the external voltage.

19. The circuit according to claim 15, wherein the driving force control unit comprises a plurality of PMOS transistors that receive the initial setting signal through corresponding gate terminals, have source terminals connected to the external voltage, and have drain terminals respectively connected to a source terminal of at least one of the plurality of PMOS transistors of the driving unit.

20. The circuit according to claim 15, wherein the voltage discharge unit comprises:

a timing control unit configured to receive the initial setting signal so as to control a timing when the down-converted voltage is lowered; and a discharge unit configured to lower the down-converted voltage.

21. The circuit according to claim 20, wherein the timing control unit comprises:

a delay unit configured to delay the initial setting signal by a predetermined time and generate a delayed initial setting signal; and a control unit configured to control the down-converted voltage to be lowered when the delayed initial setting signal is activated.

22. The circuit according to claim 21, wherein the delay unit delays the initial setting signal from the time when the power-up operation is started to the time when the down-converted voltage is driven to be higher by a predetermined level than the target voltage.

23. A down-converting voltage generating circuit, comprising:

a segment driving unit configured to output a first output voltage derived from an external voltage in an initial stage of a power-up operation and then lower the first output voltage to substantially a level of a target voltage after a first predetermined time elapses;

a target driving unit configured to drive a second output voltage derived from the external voltage in response to a level of a reference voltage;

a selection unit configured to output one of the first and second output voltages as a down-converted voltage in response to a selection signal; and a selection signal generation unit configured to generate the activated selection signal when the target driving unit drives the second output voltage whose voltage level is lower than that of the target voltage after the power-up operation.

24. The circuit according to claim 23, wherein the segment is driving unit comprises:

a first output voltage driving unit configured to output the level of the external voltage as the first output voltage when an activated initial setting signal is inputted; and a voltage discharge unit configured to lower the first output voltage to substantially the level of the target voltage in response to the initial setting signal, wherein the initial setting signal is activated in the power-up operation and then deactivated after a second predetermined time elapses.

25. The circuit according to claim 24, wherein a driving force for driving the first output voltage of the first output voltage driving unit is set lower than that for driving the second output voltage of the target driving unit.

26. The circuit according to claim 24, wherein the voltage discharge unit comprises:

a timing control unit configured to receive the initial setting signal so as to control a timing when the first output voltage is lowered; and a discharge unit configured to lower the first output voltage.

27. The circuit according to claim 26, wherein the timing control unit comprises:

a delay unit configured to delay the initial setting signal by a first predetermined time and generate a delayed initial setting signal; and a control unit configured to control the first output voltage to be lowered when the delayed initial setting signal is activated.

28. The circuit according to claim 27, wherein the delay unit is configured to delay the initial setting signal from the time when the power-up operation is started to the time when the first output voltage is driven to be higher by a predetermined level than the target voltage.

29. The circuit according to claim 23, wherein the selection signal generation unit is configured to generate the selection signal by performing a logic combination on the initial setting signal, the second output voltage, and the target voltage.

30. The circuit according to claim 29, wherein, when the initial setting signal is activated, the selection signal generation unit generates the deactivated selection signal.

31. The circuit according to claim 30, wherein, when the initial setting signal is deactivated, the selection signal generation unit generates the activated selection signal when the second output voltage is lower than the target voltage.

32. The circuit according to claim 23, wherein the selection signal generation unit comprises:

a comparator configured to compare the level of the target voltage and a level of the second output voltage; and circuitry configured to receive an output signal of the comparator and the inverted initial setting signal and output the selection signal.

33. The circuit according to claim 32, wherein the comparator outputs a low level when the level of the second output voltage is higher than that of the target voltage, and outputs a high level when the level of the second output voltage is lower than that of the target voltage.

34. The circuit according to claim 23, wherein the selection unit outputs the first output voltage as the down-converted voltage when the deactivated selection signal is applied, and outputs the second output voltage as the down-converted voltage when the activated selection signal is applied.

* * * * *